US008397659B1

(12) United States Patent
Nastrom et al.

(10) Patent No.: US 8,397,659 B1
(45) Date of Patent: Mar. 19, 2013

(54) BOAT LIFT CANOPY ENTRANCE

(76) Inventors: Dennis H. Nastrom, Blaine, MN (US); Brian L. Nastrom, Blaine, MN (US); Steven W. Nastrom, Ramsey, MN (US)

( * ) Notice: Subject to any disclaimer, the term of this patent is extended or adjusted under 35 U.S.C. 154(b) by 490 days.

(21) Appl. No.: 12/700,765

(22) Filed: Feb. 5, 2010

(51) Int. Cl.
*B63B 17/00* (2006.01)

(52) U.S. Cl. ..... 114/361; 135/122; 405/3

(58) Field of Classification Search ..... 114/44, 114/51, 361; 135/88.01, 122, 143, 87, 88.03, 135/96, 97, 117, 124, 138; 405/1, 2, 3
See application file for complete search history.

(56) References Cited

U.S. PATENT DOCUMENTS

| | | | | | |
|---|---|---|---|---|---|
| 932,909 | A | * | 8/1909 | Saunders | 135/97 |
| 3,083,540 | A | * | 4/1963 | Smith | 405/3 |
| 5,281,077 | A | * | 1/1994 | Phillips | 405/3 |
| 5,573,026 | A | * | 11/1996 | Griffith | 135/122 |
| 5,820,189 | A | * | 10/1998 | Tew | 296/26.11 |

* cited by examiner

*Primary Examiner* — Lars A Olson
(74) *Attorney, Agent, or Firm* — Dave Alan Lingbeck

(57) ABSTRACT

A boat lift canopy entrance for easily entering and exiting a boat upon a boat lift with a canopy without having to stoop and trip while getting into out of the boat. The boat lift canopy entrance includes an entrance closure assembly being fastenable over an entranceway of a canopy and having a piece of material capable of being removably disposed over and closing the entranceway.

18 Claims, 4 Drawing Sheets

BOAT LIFT CANOPY ENTRANCE

BACKGROUND OF THE INVENTION

1. Field of the Invention

The present invention relates to entrances/doors and more particularly pertains to a new boat lift canopy entrance for easily entering and exiting a boat upon a boat lift with a canopy without having to stoop and trip while getting into out of the boat.

2. Description of the Prior Art

The use of entrances/doors is known in the prior art. More specifically, entrances/doors heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a boat hoist canopy comprising a skirt having a plurality of panels being adapted to be hung from the canopy frame with one of the panels being a door panel which can be raised and lowered to provide access to a boat. The door panel has a pipe to weigh the door panel down in a lowered position. Another prior art includes a boat lift canopy comprising a tubing frame and a canopy being securely disposed over the tubing frame. Also another prior art includes a cover for a floating dock comprising a plurality of support elements being mounted upon a floating boat dock and also including a top canvas, side canvasses, front and rear canvasses with the front canvas having a canvas door which is rolled up with a rope.

While these devices fulfill their respective, particular objectives and requirements, the aforementioned patents do not disclose a new boat lift canopy entrance.

SUMMARY OF THE INVENTION

The general purpose of the present invention, which will be described subsequently in greater detail, is to provide a new boat lift canopy entrance which has many of the advantages of the entrances/doors mentioned heretofore and many novel features that result in a new boat lift canopy entrance which is not anticipated, rendered obvious, suggested, or even implied by any of the prior art entrances/doors, either alone or in any combination thereof. The present invention includes an entrance closure assembly being fastenable over an entranceway of a canopy and having a piece of material capable of being removably disposed over and closing the entranceway. None of the prior art includes the combination of the elements of the present invention.

There has thus been outlined, rather broadly, the more important features of the boat lift canopy entrance in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new boat lift canopy entrance which has many of the advantages of the entrances/doors mentioned heretofore and many novel features that result in a new boat lift canopy entrance which is not anticipated, rendered obvious, suggested, or even implied by any of the prior art entrances/doors, either alone or in any combination thereof.

Still another object of the present invention is to provide a new boat lift canopy entrance for easily entering and exiting a boat upon a boat lift with a canopy without having to stoop and trip while getting into out of the boat.

Still yet another object of the present invention is to provide a new boat lift canopy entrance that provides a door for canopies which have little separation between the canopies and the boats so that users of the boats can get into and out of their boats without bumping into the canopies or making it impossible for those who are ambulatory-challenged to get in or out of the boats.

Even still another object of the present invention is to provide a new boat lift canopy entrance which doesn't limit the protections afforded by the canopy with the canopy maintaining its full structure with the entrance being fastened in place.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
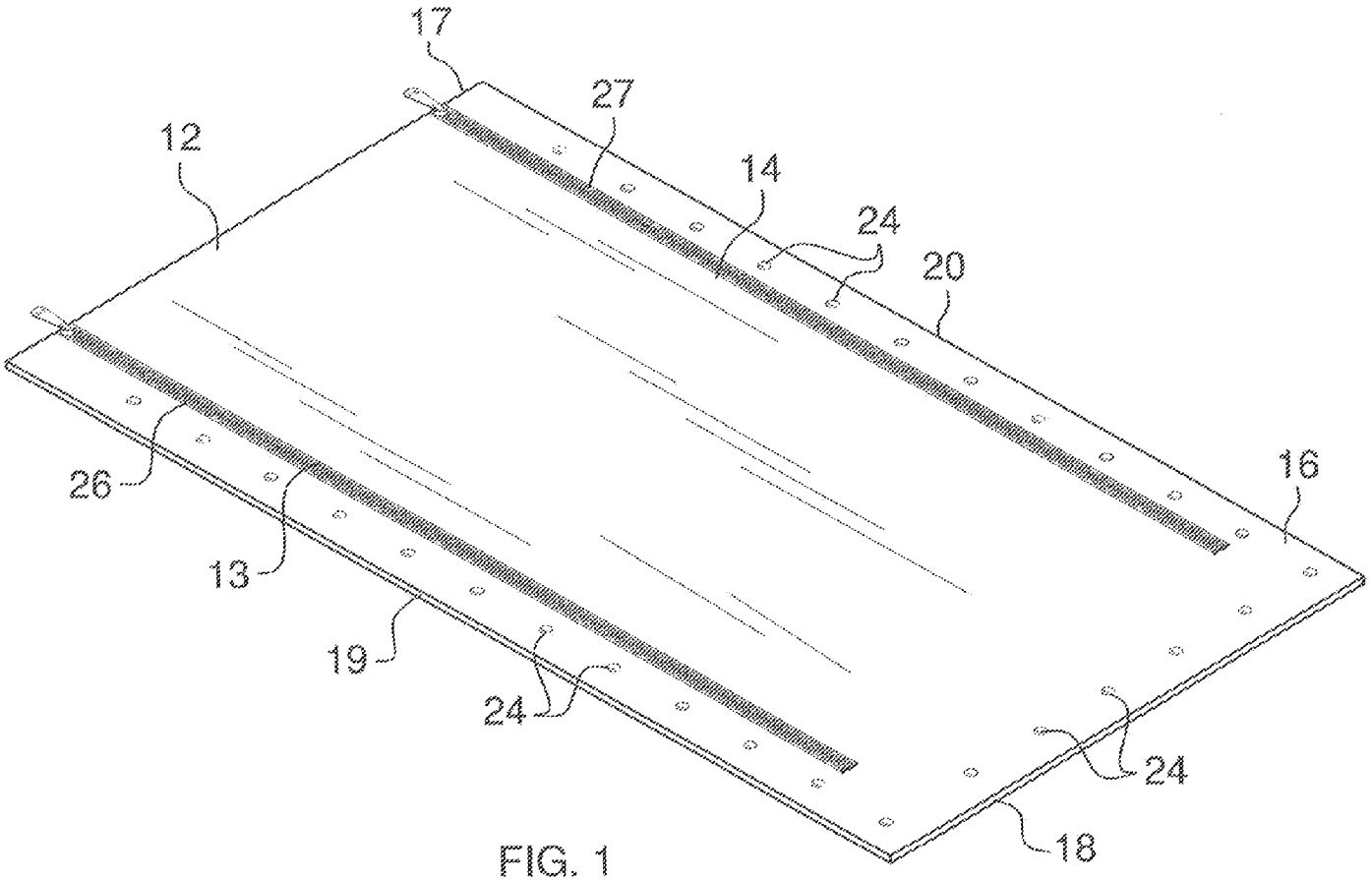
FIG. 1 is a rear perspective view of a new boat lift canopy entrance according to the present invention.
Figure 2:
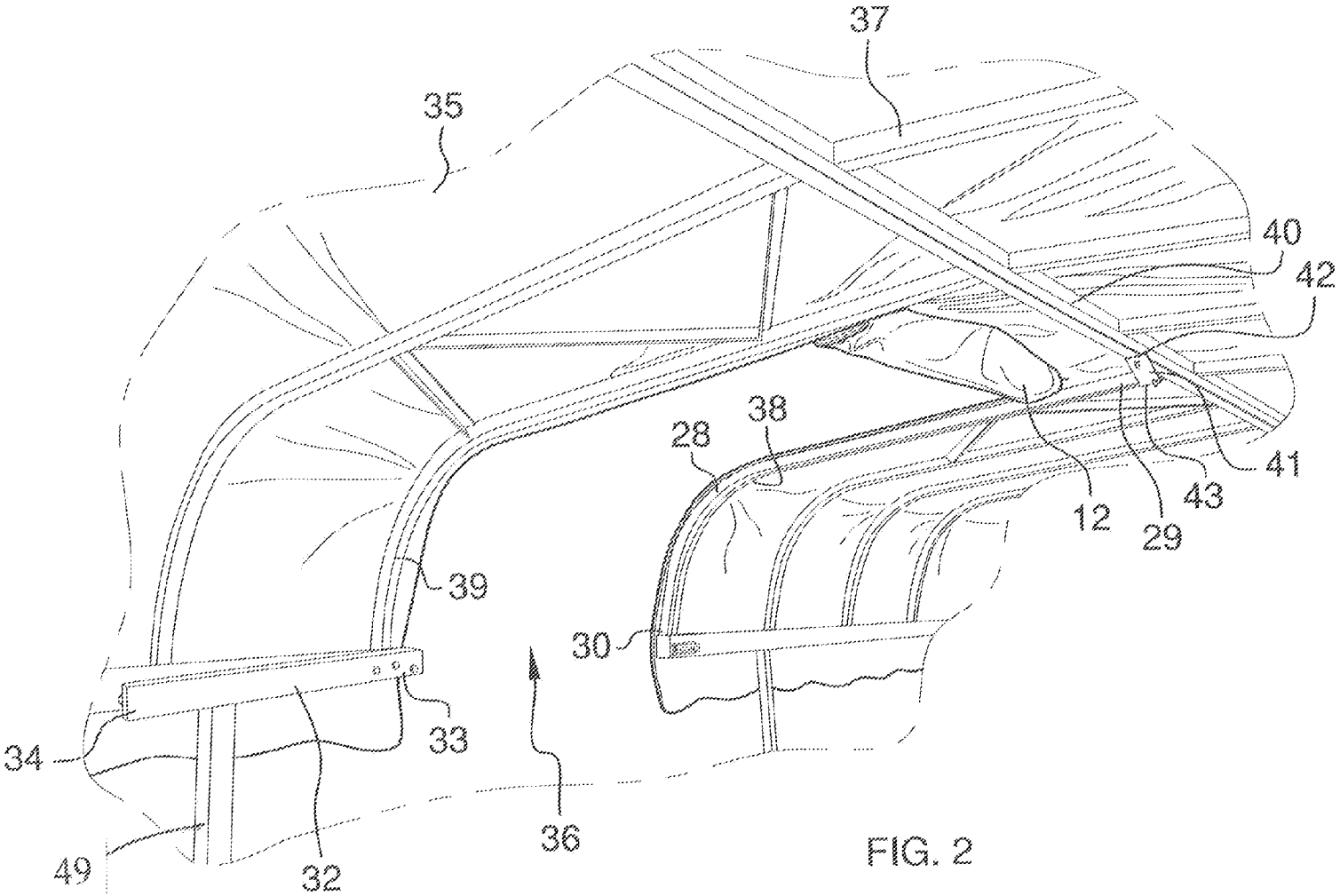
FIG. 2 is a rear perspective view of the present invention showing the underside of the canopy with the entrance being open.
Figure 3:
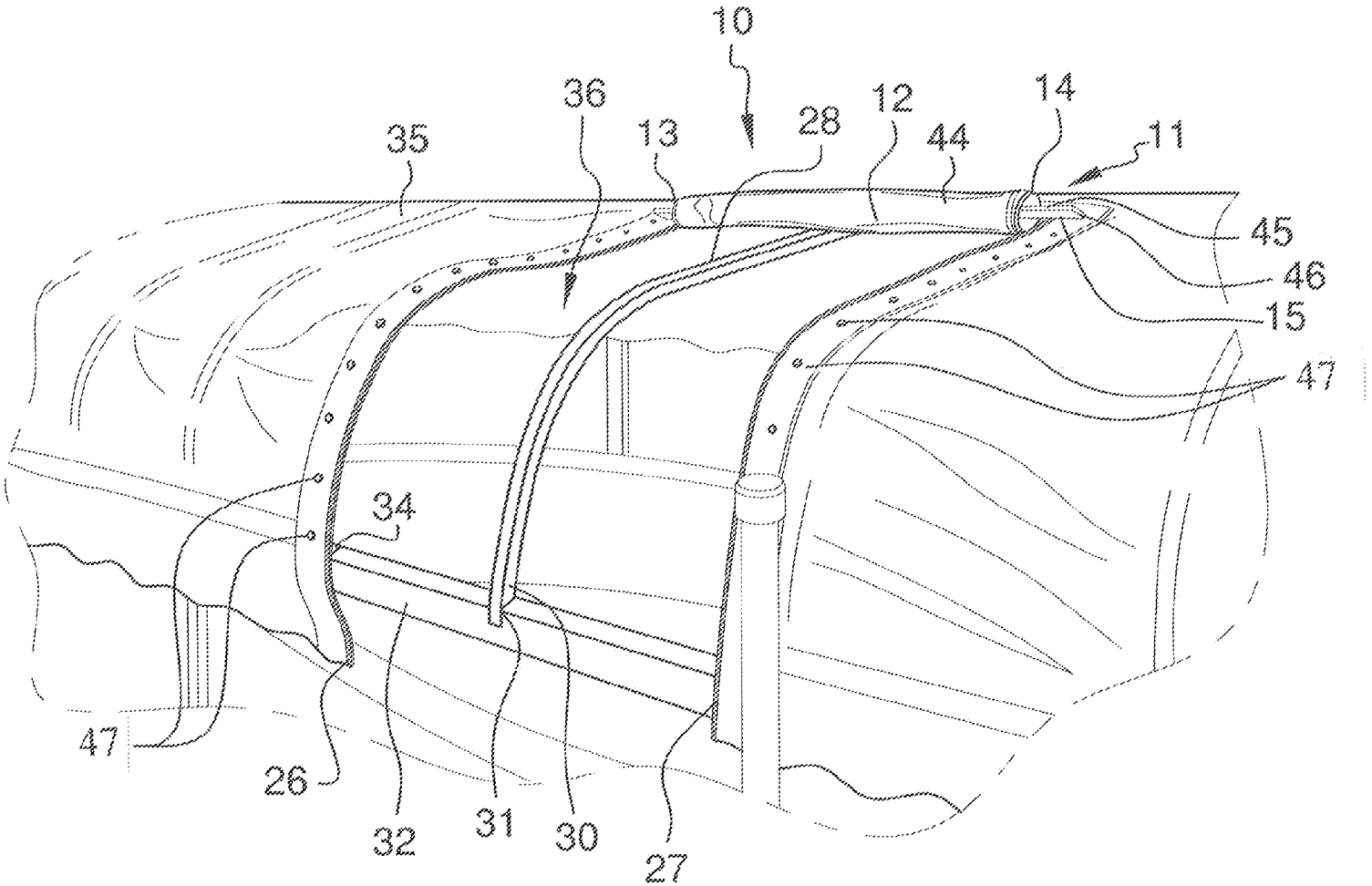
FIG. 3 is a front perspective view of the present invention showing the outside of the canopy entrance.
Figure 4:
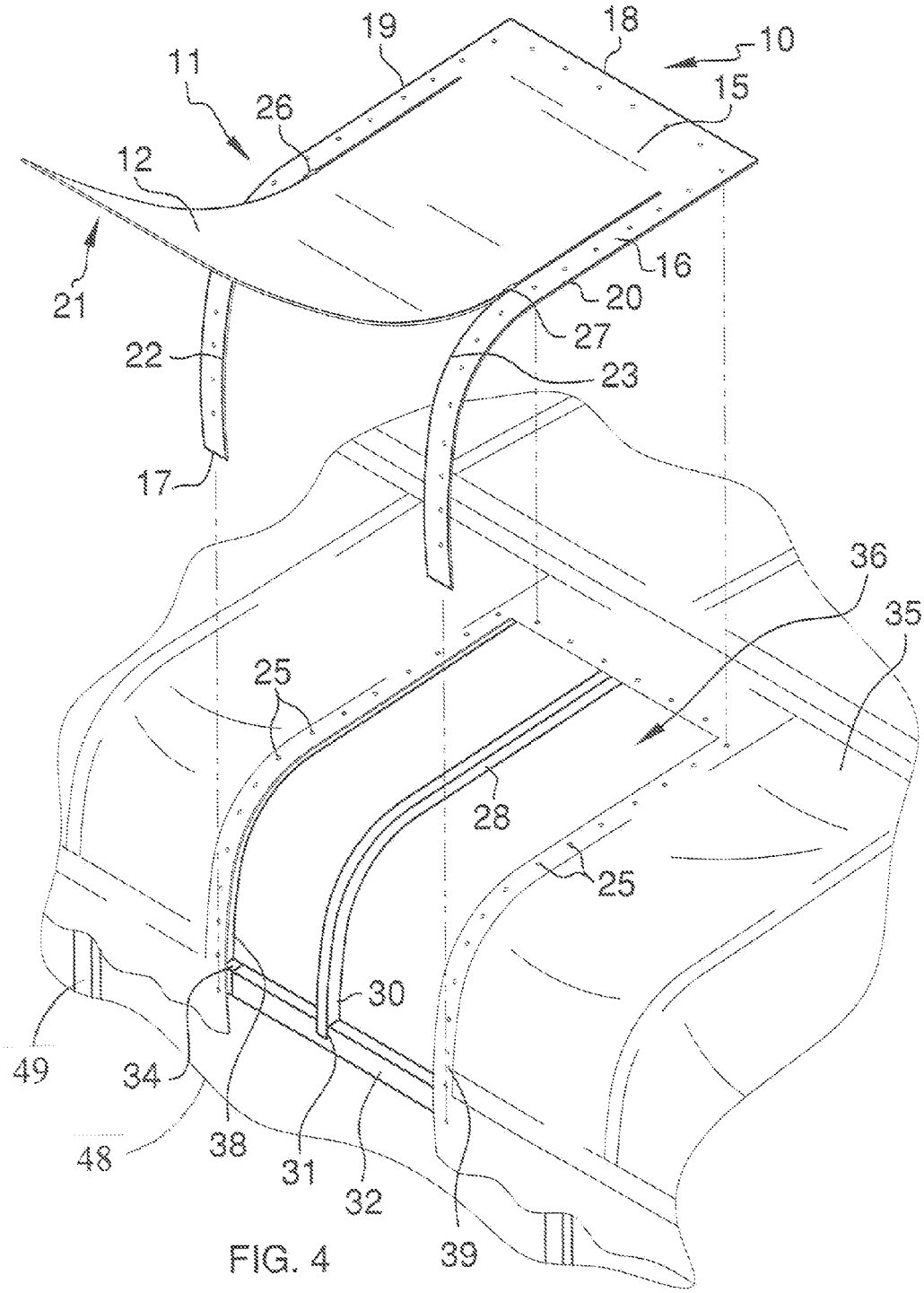
FIG. 4 is a upper front perspective view of the present invention showing the outside of the canopy with the sheet of material being fastened to the canopy support members.

With reference now to the drawings, and in particular to FIGS. 1 through 4 thereof, a new boat lift canopy entrance embodying the principles and concepts of the present invention and generally designated by the reference numeral 10 will be described.

As best illustrated in FIGS. 1 through 4, the boat lift canopy entrance 10 generally comprises an entrance closure assembly 11 being fastenable over an entranceway 36 through a canopy 35 of a boat lift 49 and above a boat 48 and having a piece of material 12 capable of being removably disposed over the entranceway 36. The entrance closure assembly 11 also includes a sheet of material 16 capable of being fastened to the canopy 35 and having an opening 21 being spacedly disposed between side edges 19,20 of the sheet of material 16 and extending through a bottom edge 17 and terminating near a top edge 18 of the sheet of material 16. The piece of material 12 is removably fastened in the opening 21 of the sheet of material 16 and has a top edge 15 which is integrally connected to the sheet of material 16 along a top edge defining the opening 21 of the sheet of material 16.

The entrance closure assembly 11 also includes a plurality of first fasteners 24 being spacedly and conventionally secured to the sheet of material 16, and also includes a plurality of second fasteners 25 being spacedly and conventionally secured to first and second braces 38,39 of the frame 37 which are opposedly disposed adjacent to the entranceway 36 through the canopy 35. The first fasteners 24 such as female fasteners are conventionally fastened to the second fasteners 25 such as male fasteners to fasten the sheet of material 16 to the canopy 35 and to the first and second braces 38,39 of the frame 37 in the entranceway 36. The first fasteners 24 are spacedly aligned along and near the side edges 19,20 of the sheet of material 16. In addition, a plurality of the first fasteners 24 are spacedly aligned along and near the top edge 18 of said sheet of material 16. A plurality of the second fasteners 25 are spacedly and conventionally secured to the canopy 35 and across member 40 of the frame 37 which interconnects to the first and second braces 38,39 of the frame 37. The first fasteners 24 along and near the top edge 18 of the sheet of material 16 are conventionally fastened to the second fasteners 25 secured to the canopy 35 and the cross member 40 of the frame 37.

The entrance closure assembly 11 further includes fastening members 26,27 being conventionally attached along side edges 22,23 defining the opening 21 of the sheet of material 16 and also being conventionally attached along side edges 13,14 of the piece of material 12. The side edges 13,14 of the piece of material 12 are fastenable to the sheet of material 16 to close the opening 21 of the sheet of material 16 and the entranceway 36 through the canopy 35. The fastening members are zippers 26,27. One of the zippers 26 is attached and sewn along one of the side edges 13 of the piece of material 12 and an adjacent one of the side edges 22 defining the opening 21 of the sheet of material 16. Another of the zippers 27 is attached and sewn along another of the side edges 14 of the piece of material 12 and an adjacent one of the side edges 23 defining the opening 21 of the sheet of material 16.

The entrance closure assembly 11 further includes a linkage member 41 having a first end 42 which is pivotally and conventionally attached to a cross member 40 of the frame 37 and also includes a support member 28 having a top end 29 being pivotally and conventionally connected to a second end 43 of the linkage member 41 and having a bottom end 30 being removably engaged to the first brace 38 of the frame 37 adjacent to the entranceway 36 through the canopy 35. The entrance closure assembly 11 further includes a cross bar 32 having a first end 33 being hingedly attached to the frame 37 which is adjacent to the entranceway 36 through the canopy 35 and which is opposed to the first brace 38, and having a second end 34 being removably and conventionally latched to the first brace 38 of the frame 37 with the cross bar 32 being removably extended across the entranceway 36 of the canopy 35. The bottom end 30 of the support member 28 is removably engaged to the cross bar 32. The support member 28 is removably and pivotally disposed in the entranceway 36 with the piece of material 12 being supported upon the support member 28 upon the piece of material 12 being closed over the opening 21 of the sheet of material 16 and over the entranceway 36 of the canopy 35. The bottom end 30 of the support member 28 has a peg 31 being conventionally attached thereto with the peg 31 being removably engaged intermediate of the cross bar 32 upon the piece of material 12 being removably closed over the entranceway 36 of the canopy 35.

As a second embodiment, the piece of material 12 is removably fastened in the entranceway 36 of the canopy 35 and has a top edge 15 which is integrally attached to a top edge defining the entranceway 36 of the canopy 35. The entrance closure assembly 11 also includes a plurality of fasteners 47 being spacedly and conventionally secured to first and second braces 38,39 of the frame 37 which are opposedly disposed adjacent to the entranceway 36 of the canopy 35. The fasteners 47 are conventionally fastened to the canopy 35 and to the first and second braces 38,39 of the frame 37 in the entranceway 36. The fasteners 47 are spacedly aligned along and near side edges 13,14 defining the entranceway 36 of the canopy 35. The entrance closure assembly 11 further includes fastening members 26,27 being attached and sewn along side edges defining the entranceway 36 of the canopy 35 and being attached and sewn along the side edges 13,14 of the piece of material 12. The side edges 13,14 of the piece of material 12 are fastenable to the canopy 35 to close the entranceway 36 of the canopy 35. The fastening members are zippers 26,27. One of the zippers 26 is attached and sewn along one of the side edges 13 of the piece of material 12 and an adjacent one of the side edges defining the entranceway 36 of the canopy 35, and another of the zippers 27 is attached and sewn along another of the side edges 14 of the piece of material 12 and an adjacent one of the side edges defining the entranceway 36 of the canopy 35.

In use, the user opens the entranceway 36 through the canopy 35 by unzipping the zippers 26,27 with the user rolling up the piece of material 12 to open the entranceway 36 in the canopy 35 with the rolled up piece of material 12 being securely supported upon a top of the canopy 35 and the support member 28 being pivoted and fastened to the first brace 38 and the cross bar 32 being swung back away from the entranceway 36. To close the entranceway 36 in the canopy 35, the user swings and fastens the cross bar 32 across the entranceway 36 and pivots and fastens the support member 28 to the cross bar 32 and unrolls the piece of material 12 over the entranceway 36 and then zips the side edges 13,14 of the piece of material 12 to the side edges defining the entranceway 36 of the canopy 35. Preferably, a bottom end 45 of the piece of material 12 is looped to form a sleeve 44. An elongate guide member 46 is inserted in the sleeve 44 to aid the user to roll up and unroll the piece of material 12.

As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the boat lift canopy entrance. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A boat lift canopy entrance in a canopy supported by a frame comprising:

an entrance closure assembly being fastenable over an entranceway of a canopy of a boat lift and having a piece of material capable of being removably disposed over and closing the entranceway, said entrance closure assembly also including a sheet of material being fastenable to the canopy and having an opening being spacedly disposed between side edges of said sheet of material and extending through a bottom edge and terminating near a top edge of said sheet of material, said opening being dimensioned for a person to enter and exit therethrough.

2. The boat lift canopy entrance as described in claim 1, wherein said piece of material is removably fastened in said opening of said sheet of material and has a top edge which is attached to said sheet of material along a top edge defining said opening of said sheet of material.

3. The boat lift canopy entrance as described in claim 2, wherein said entrance closure assembly also includes a plurality of first fasteners being spacedly secured to said sheet of material, and also includes a plurality of second fasteners being spacedly secured to the canopy and to first and second braces of the frame which are opposedly disposed adjacent to the entranceway of the canopy, said first fasteners being fastened to said second fasteners to fasten said sheet of material to the canopy and to the first and second braces of the frame and to removably close the entranceway.

4. The boat lift canopy entrance as described in claim 3, wherein a plurality of said first fasteners are spacedly and securely aligned along and near side edges of said sheet of material.

5. The boat lift canopy entrance as described in claim 4, wherein a plurality of said first fasteners are spacedly and securely aligned along and near said top edge of said sheet of material.

6. The boat lift canopy entrance as described in claim 5, wherein a plurality of said second fasteners are spacedly secured to the canopy and cross member of the frame which interconnects to the braces of the frame, said first fasteners along and near said top edge of said sheet of material being fastenable to said second fasteners secured to the canopy and the cross member of the frame.

7. The boat lift canopy entrance as described in claim 3, wherein said entrance closure assembly further includes fastening members being disposed along side edges defining said opening of said sheet of material and being attached along side edges of said piece of material, said side edges of said piece of material being fastenable to said sheet of material to close said opening of said sheet of material and said entranceway of the canopy.

8. The boat lift canopy entrance as described in claim 7, wherein said fastening members are zippers, one of said zippers being attached along one of said side edges of said piece of material and an adjacent one of said side edges defining said opening of said sheet of material and another of said zippers being attached along another of said side edges of said piece of material and an adjacent one of said side edges defining said opening of said sheet of material.

9. The boat lift canopy entrance as described in claim 2, wherein said piece of material has a bottom end which is looped to form a sleeve, said entrance closure assembly also including an elongate guide member being inserted in said sleeve for rolling up and unrolling said piece of material.

10. The boat lift canopy entrance as described in claim 1, wherein said piece of material has a bottom end which is looped to form a tubular portion, said entrance closure assembly also including an elongate guide member being inserted in said tubular portion for rolling up and unrolling said piece of material.

11. A boat lift canopy entrance comprising:

an entrance closure assembly being fastenable over an entranceway of a canopy of a boat lift and having a piece of material capable of being removably disposed over and closing the entranceway, said entrance closure assembly further including a linkage member having a first end being pivotally attached to a cross member of the frame and also including a support member having a top end being pivotally connected to a second end of said linkage member and having a bottom end being removably connected to a first brace of the frame adjacent to the entranceway of the canopy.

12. The boat lift canopy entrance as described in claim 11, wherein said entrance closure assembly further includes a cross bar having a first end being hingedly attached the frame which is adjacent to the entranceway through the canopy and which is opposed to the first brace, said cross bar having a second end being removably latched to the first brace of the frame with said cross bar being removably extended across the entranceway of the canopy, said bottom end of said support member being removably engaged to said cross bar.

13. The boat lift canopy entrance as described in claim 12, wherein said support member is removably and pivotally disposed in the entranceway with said piece of material being supported upon said support member upon said piece of material being closed over said opening of said sheet of material and over the entranceway of the canopy.

14. The boat lift canopy entrance as described in claim 12, wherein said bottom end of said support member has a peg being attached thereto, said peg being removably engaged intermediate of said cross bar upon said piece of material being removably closed over the entranceway of the canopy.

15. A boat lift canopy entrance comprising:

an entrance closure assembly being fastenable over an entranceway of a canopy of a boat lift and having a piece of material capable of being removably disposed over and closing the entranceway, said piece of material being removably fastened in the entranceway of the canopy and having a top edge which is attached to a top edge defining the entranceway of the canopy, said entrance closure assembly also including a plurality of fasteners being spacedly secured to the canopy and to first and second braces of the frame which are opposedly disposed adjacent to the entranceway of the canopy.

16. The boat lift canopy entrance as described in claim 15, wherein said fasteners are spacedly aligned along and near side edges defining the entranceway of the canopy.

17. The boat lift canopy entrance as described in claim 16, wherein said entrance closure assembly further includes fastening members being attached along side edges defining the entranceway of the canopy and being attached along side edges of said piece of material, said side edges of said piece of material being fastenable to the canopy to close the entranceway of the canopy.

18. The boat lift canopy entrance as described in claim 17, wherein said fastening members are zippers, one of said zippers being attached along one of said side edges of said piece of material and an adjacent one of said side edges defining the entranceway of the canopy and another of said zippers being attached along another of said side edges of said piece of material and an adjacent one of said side edges defining the entranceway of the canopy.

* * * * *